US006414040B1

(12) United States Patent
Van Driel et al.

(10) Patent No.: US 6,414,040 B1
(45) Date of Patent: Jul. 2, 2002

(54) COMPOSITION FOR GENERATING SMOKE

(75) Inventors: Christoffel Adrianus Van Driel, Delft; Adriana Petronella Martina Leenders, Den Hoorn; Arnold Barend Leeuwenburgh, Zoetermeer; Elisabeth Schonewille, Haarlem, all of (NL)

(73) Assignee: Nederlandse Organisatie voor Toegepast-Natuurwetenschappelijk Onderzoek TNO, Delft (NL)

( * ) Notice: Subject to any disclaimer, the term of this patent is extended or adjusted under 35 U.S.C. 154(b) by 0 days.

(21) Appl. No.: 09/380,740

(22) PCT Filed: Mar. 13, 1998

(86) PCT No.: PCT/NL98/00149

§ 371 (c)(1),
(2), (4) Date: Sep. 30, 1999

(87) PCT Pub. No.: WO98/40330

PCT Pub. Date: Sep. 17, 1998

(30) Foreign Application Priority Data

Mar. 13, 1997 (NL) ..... 1005529

(51) Int. Cl.[7] ..... C09K 3/30; C06D 3/00; C06B 33/02

(52) U.S. Cl. ..... 516/2; 516/4; 102/334; 102/289; 149/44; 149/117

(58) Field of Search ..... 516/2, 4; 102/334, 102/513, 368, 289; 424/40; 89/1.1; 149/44, 117

(56) References Cited

U.S. PATENT DOCUMENTS

| | | | | |
|---|---|---|---|---|
| 1,886,394 A | | 11/1932 | Goss | 424/40 |
| 2,939,780 A | * | 6/1960 | Brock | 149/117 |
| 3,329,624 A | | 7/1967 | Ashton | 516/2 |
| 3,625,855 A | | 12/1971 | Douda | 516/2 |
| 3,678,855 A | * | 7/1972 | Semel | 102/334 |
| 4,474,715 A | * | 10/1984 | Weber et al. | 102/334 |
| 4,968,365 A | * | 11/1990 | Krone | 102/334 |

FOREIGN PATENT DOCUMENTS

| | | | |
|---|---|---|---|
| DE | 11 80 657 | | 10/1964 |
| DE | 2250102 | * | 4/1974 |
| DE | 24 51 701 | | 5/1976 |
| DE | 28 19 850 | | 7/1979 |
| FR | 2 249 590 | | 5/1975 |
| GB | 2 056 632 | | 3/1981 |

OTHER PUBLICATIONS

Database DWPI on East, week 197418, London: Derwent Publications Ltd., AN 1974–32836V, Class K04, DE 2 250 102 A (Tiedemann C), abstract, 1974.*

J. Dolinek et al., XP000431169, "Metal Chloride Smoke–generating Composition With Increased Infrared Screening Properties", Chemical Abstracts, vol. 199, No. 10, Sep. 6, 1993, p. 226.

* cited by examiner

*Primary Examiner*—Daniel S. Metzmaire
(74) *Attorney, Agent, or Firm*—Young & Thompson

(57) ABSTRACT

A composition for generating smoke, consisting essentially of at least one chlorine compound having a chlorine content of at least 56% by weight of the chlorine compound, and a mixture of at least one metal oxide and at least one metal. The metal oxide is an alkaline-earth metal oxide and the metal is an alkaline-earth metal. The molar fraction of alkaline-earth metal, based on the total number of moles of alkaline-earth metal and alkaline-earth metal oxide, is between 0.33 and 0.67. Preferably, the chlorine compound is hexachloroethane. Also preferably, the molar fraction of the mixture of alkaline-earth metal and alkaline-earth metal oxide in the composition is between 0.37 and 0.91. The alkaline-earth metal comprises particles having an average size of 50–100 $\mu$m and particles having an average size of 150–300 $\mu$m.

8 Claims, 1 Drawing Sheet

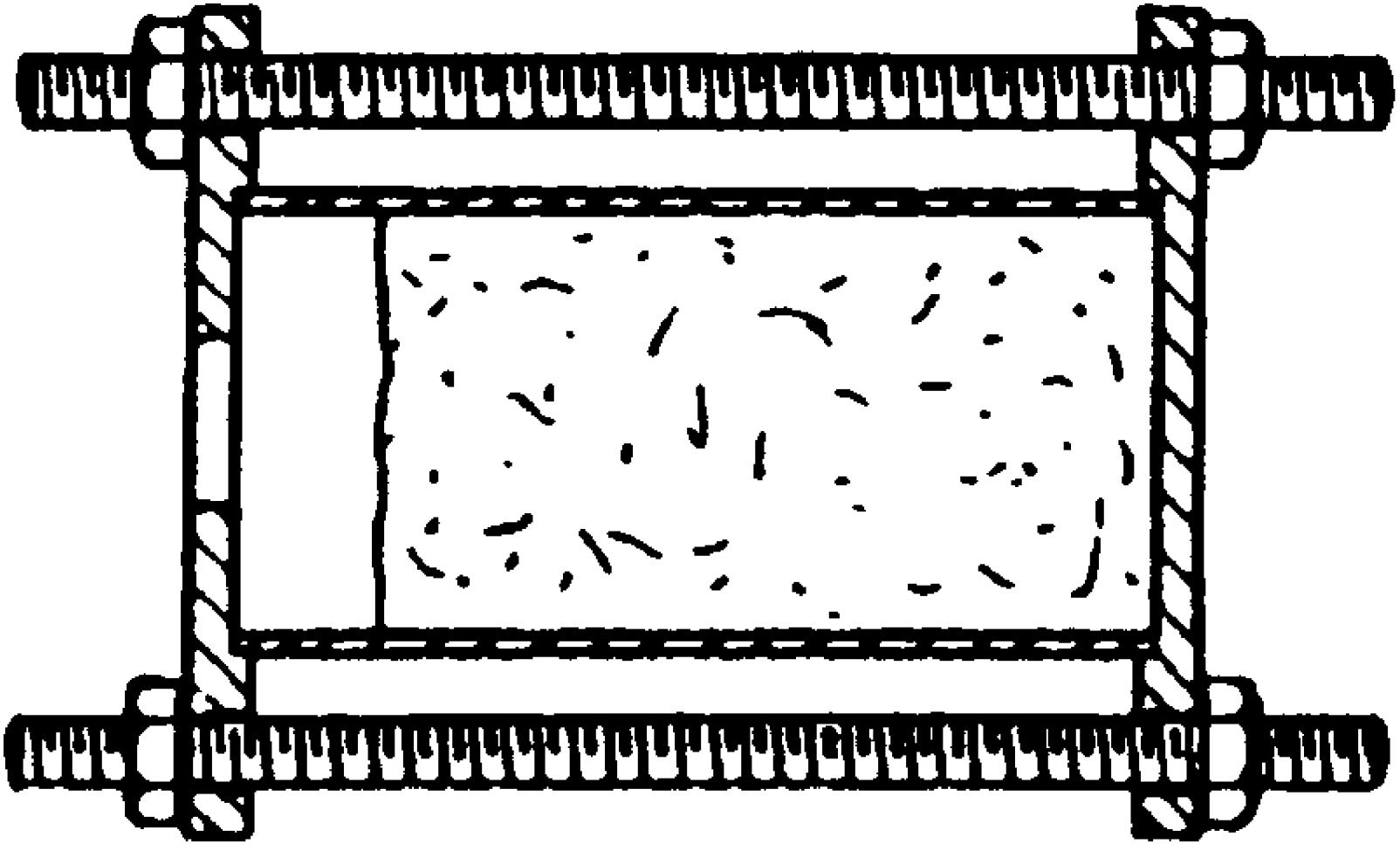

COMPOSITION FOR GENERATING SMOKE

FIELD OF THE INVENTION

The invention relates to a composition for generating smoke, the composition comprising one or more chlorine compounds having a chlorine content of at least 56% by weight and a mixture of one or more metal oxides and one or more metals.

BACKGROUND OF THE INVENTION

Such a composition is disclosed by DE-A-2,451,701, said composition consisting of a chlorine-containing compound which contains 50–70% by weight of chlorine, a metal and a metal oxide. The metal can be zinc, aluminium, magnesium, titanium, iron, and aluminium-magnesium alloy or an alloy-like compound such as calcium silicide or iron(II) silicon. According to p. 11, second paragraph, the metal oxide can be zinc oxide, magnesium oxide or iron(III) oxide, the compositions according to the examples always containing zinc oxide. The function of the metal oxide is not reported. According to DE-A-2,451,701, the chlorine-containing compound is preferably a chlorine-containing polymer. Such a polymer has the advantage, compared with the customary hexachloroethane, that the polymer hydrolyses only slowly to form HCl and other decomposition products. According to the description, HCl and said decomposition products react exothermally with the metal present in the composition, as a result of which autoignition of the composition may take place or as a result of which the composition may even explode. Thus an embodiment of the composition according to DE-A-2,451,701 (p. 8) consists of 35% by weight of a chlorine-containing paraffin wax, 20% by weight of aluminium and 45% by weight of zinc oxide, i.e. a composition in which the molar fraction of aluminium, based on the total number of moles of aluminium and zinc oxide, is 0.57. This composition, however, is very difficult to ignite, whereas a comparable composition comprising hexachloroethane instead of the chlorine-containing paraffin wax will explode under the same conditions. It is also reported that compositions comprising hexachloroethane, zinc oxide, and an amount of 15% by weight of a metal explode readily, so that in compositions of this type the amount of metal to be used is greatly restricted.

Compositions for generating smoke are generally used to mask objects and people, the smoke reducing the contrast between the object or the person and the background to such an extent that the object or the person is scarcely visible, or is not visible at all.

The most frequently used composition for generating smoke consists mainly of hexachloroethane and zinc oxide. The smoke is generated by combustion of the composition, forming hygroscopic particles of zinc chloride. These particles absorb moisture from the atmosphere, thus producing smoke. For example, FR-A-2,249,590 describes compositions which contain hexachloroethane, zinc oxide, an organic binder and calcium silicide, magnesium silicide or aluminium silicide. U.S. Pat. No. 3,625,855 describes compositions which comprise a chlorine-containing compound, for example hexachlorobenzene, zinc oxide, magnesium and a binder. An important drawback of such compositions is that zinc chloride is toxic and, in particular, may cause pulmonary oedema, due to the fact that zinc chloride reacts with water in the lungs to form hydrogen chloride which attacks the lungs. The formation of toxic metal chlorides can be avoided, for example, by preparing a composition which generates potassium chloride or magnesium chloride instead of zinc chloride. In this case, combustion gives rise to hygroscopic particles of magnesium chloride or potassium chloride. Magnesium-containing compositions have the drawback, however, that they burn too rapidly and at an excessively high temperature, and these compositions can therefore not be used in a container such as a smoke hand grenade or smoke canister, since a combustion time of ±1 minute is desirable for such containers. A composition which generates potassium chloride in particular has the drawback that the smoke formed is of considerably lower quality (high transmission) than if a composition comprising hexachloroethane and zinc oxide is burnt.

GB-A-2,056,632 describes a smoke grenade comprising a composition which contains hexachloroethane, titanium dioxide and aluminium and wherein the molar fraction of aluminium, based on the total number of moles of aluminium and titanium dioxide, is between 0.05 and 0.75. Titanium dioxide is used, in particular, because it is much cheaper than titanium (p. 3, lines 50–52 and p. 5, lines 88–90). In addition it is claimed that the use of titanium dioxide has the advantage, compared with zinc oxide, that the smoke formed by combustion of the composition which contains titanium dioxide has a lower condensation point. Consequently, the composition according to GB-A-2,056,632 can be used, for example, in snow. A further advantage of the composition which contains titanium dioxide is that this composition is effective not only in the visible range of the electromagnetic spectrum, but also in the infrared range.

In addition, the German Patent Application 2,250,102 describes a candle for dispersing fog, which comprises 30–50% by weight of hexachloroethane, 45–65% by weight of magnesium and 3–7% by weight of magnesium oxide, the sum of the constituents being 100% by weight. The molar fraction of magnesium, based on the total number of moles of magnesium and magnesium oxide, is therefore approximately from 0.11 to 0.15. The various constituents are present in the candle in finely dispersed form, for example as a powder. The candle functions as follows. When the candle is ignited, the magnesium and the magnesium oxide react with hexachloroethane, primarily forming magnesium chloride particles. These particles are highly hygroscopic, and will therefore absorb the moisture present in the atmosphere, with the result that the fog disappears.

It is known from "Propellants, Explos., Pyrotech.", vol. 9(3), pp. 108–114 (1984) that certain metal oxides, such as zinc oxide, magnesium oxide, copper oxide and aluminium oxide make it more difficult to ignite a composition of hexachloroethane and "silumin" (silumin is a group of alloys of aluminium and silicon which contain approximately 12% of silicon and have a density of from approximately 2.63 to 2.65) or retard the combustion of such a composition. For example, a composition consisting of approximately 26% by weight of magnesium oxide, approximately 51% by weight of hexachloroethane and approximately 22% by weight of silumin was virtually impossible to ignite. When the amount of magnesium oxide was reduced to approximately 12% by weight, combustion did take place, but the burning rate of this composition was much lower than that of a composition which did not contain any metal oxide. An earlier study by the same authors ["Propellants, Explos., Pyrotech.", vol. 9(2), pp. 64–71 (1984)] showed that compositions comprising hexachloroethane, silumin and more than 4% by weight of magnesium oxide are difficult to burn. The combustion mechanism of such compositions is claimed to comprise a reaction in which silumin and hexachloroethane react with one another to form an "ignition catalyst". This catalyst is alleged to be deactivated by the metal oxide, for example magnesium oxide, with the formation of the metal, for example magnesium, from the metal oxide, giving rise to retardation of the combustion of the composition. It follows from the mechanism put forward by the authors that the metal formed by deactivation of the catalyst cannot play an active role during the combustion of the composition. Moreover, this study has shown that compositions for generating smoke may only contain small quantities of a metal oxide, such as magnesium oxide or zinc oxide, since with larger quantities, for example a quantity of more than 4% by weight, the compositions are very difficult or impossible to ignite and burn.

SUMMARY OF THE INVENTION

A composition has now been found for generating smoke which is not potentially explosive, with which no or virtually no toxic reaction products result from the combustion of the composition, and with which there is a high level of smoke production (high efficacy) with respect to the quantity of the composition employed. The burning rate of the composition according to the invention is such that the composition can be used in a container such as, for example, a smoke canister or a smoke hand grenade. At the same time, the burning temperature of the composition according to the invention is lower than that of the conventional compositions, with the result that igneous phenomena, which might lead to a fire in the area surrounding the location where the composition is ignited, will occur less rapidly. The smoke produced upon combustion of the composition according to the invention also has the advantage that this smoke is effective in the infrared range, since the combustion gives rise to magnesium chloride particles which react exothermally with moisture. The invention therefore relates to a composition for generating smoke comprising one or more chlorine compounds having a chlorine content of at least 56% by weight and a mixture of one or more metal oxides and one or more metals, wherein the metal oxide is an alkaline-earth metal oxide and the metal is an alkaline-earth metal, and wherein the molar fraction of alkaline-earth metal, based on the total number of moles of alkaline-earth metal and alkaline-earth metal oxide is between 0.33 and 0.67.

BRIEF DESCRIPTION OF THE DRAWING

The accompanying drawing shows a smoke-generating device embodying the present invention.

DETAILED DESCRIPTION OF THE INVENTION

The alkaline-earth metal can be an alkaline-earth metal as such or an alloy or a mixture of alkaline-earth metals or of alkaline-earth metal alloys.

The chlorine compound is preferably an organic aliphatic or aromatic compound or a silicon-containing compound, in which the number of chlorine atoms is greater than or equal to the number of carbon atoms and/or silicon atoms. Examples of such compounds are hexachloroethane, 1,1,1,2,2,3,3-heptachloropropane, 1,1,1,2,3,3,3-heptachloropropane, octachloropropane, 1,1,2,3,4,4-hexachlorobutane, 1,1,2,2,3,4,4-heptachlorobutane, 1,1,2,2,3,3,4,4-octachlorobutane, 1,2,3,4,5,6-hexachlorocyclohexane (lindane), hexachlorobenzene, hexachlorodisiliane and hexachlorodisiloxane. If desired, it would also be possible for the chlorine compound used to be a chlorinated or a chlorine-containing oligomer or polymer of one or more hydrocarbons or silicon-containing compounds, for example polychloroisoprene, polyvinyl chloride, chlorinated polyethylene, polychlorosilanes and polychlorosiloxanes. Although less preferred according to the invention, the chlorine compound could be an inorganic compound, such as phosphorus trichloride or phosphorus pentachloride. Since it is desirable for the ratio between the number of chlorine atoms and the number of carbon atoms and/or silicon atoms to be as high as possible and for the chlorine compound to be a solid, the chlorinated hydrocarbon according to the invention is preferably hexachloroethane.

If the amount of alkaline-earth metal in the composition is too high, the composition burns too rapidly and at an excessively high temperature, with the result that if the composition is used, for example, in a container, a hole will be burnt in the latter. If the quantity of alkaline-earth metal in the composition is too low, it will be obvious that the composition will be impossible, or at least very difficult, to ignite. Therefore, according to the invention the molar fraction of alkaline-earth metal, based on the total number of moles of alkaline-earth metal and alkaline-earth metal oxide, is preferably between 0.45 and 0.55.

The molar fraction of the mixture of one or more alkaline-earth metals and one or more alkaline-earth metal oxides in the composition according to the invention is preferably between 0.37 and 0.91. It has been found that such a molar fraction provides a composition which can create a large volume of smoke in a very effective manner. In particular, the molar fraction of the mixture is between 0.54 and 0.89.

The composition preferably contains, as the alkaline-earth metal, beryllium, magnesium, calcium, strontium and barium or a mixture of these and, in particular, magnesium and/or calcium.

The composition according to the invention preferably contains, as the alkaline-earth metal oxide, an oxide of beryllium, magnesium, calcium, strontium or barium and in particular magnesium oxide and/or calcium oxide.

The embodiment which, according to the invention, is highly suitable, is a composition which contains pure magnesium as the alkaline-earth metal, pure magnesium oxide as the alkaline-earth metal oxide, and hexachloroethane as the chlorine compound.

According to the invention, the alkaline-earth metal consists of particles of different average size, i.e. the alkaline-earth metal comprises a fraction of particles having an average size which differs from the average size of one or more other fractions. The alkaline-earth metal therefore preferably consists of two or more fractions, each fraction having a different average particle size. In particular, the alkaline-earth metal consists of two fractions, each having a different average particle size, the first fraction consisting of particles having an average size of 50–100 $\mu$m and the second fraction consisting of particles having an average size of 150–300 $\mu$m. The alkaline-earth metal therefore consists of particles having a bimodal size distribution.

It was found that the particles having an average size of 50–100 $\mu$m are important for regulating the ignition of the composition and for the stability with which the composition burns. If the composition contains a larger fraction of particles of this size, the composition can be ignited more easily.

The particles having an average size of 150–300 $\mu$m are particularly important for regulating the burning rate. If the composition comprises a larger fraction of particles of this size, the composition burns more slowly and at a lower temperature. The composition also burns in a less stable manner and is less easy to ignite. According to the invention, it is therefore important for the composition to contain a specific quantity of the fraction having a smaller average size and a specific quantity of the fraction having a larger average size. The alkaline-earth metal therefore preferably contains 25–50% by weight of particles having an average size of 50–100 μm and 50–75% by weight of particles having an average size of 150–300 μm.

An embodiment which is highly suitable according to the invention is a composition which mainly comprises magnesium as the alkaline-earth metal and mainly comprises magnesium oxide as the alkaline-earth metal oxide. Such a composition may optionally also contain small quantities of some other reaction-accelerating and/or reaction-regulating metal and/or metal oxide, should this be necessary or beneficial for a particular application. For example, a highly suitable composition according to the invention could, in addition to magnesium and magnesium oxide, for example contain a small quantity of aluminium, zinc, zinc oxide, titanium, calcium and/or calcium oxide.

With such an embodiment according to the invention which, in addition to the chlorine compound, the alkaline-earth metal oxide and the alkaline-earth metal, contains an additional element or an additional inorganic compound which ensures that the composition can burn in a more stable manner, it was found that by incorporating such an element or inorganic compound in the composition it is possible, in particular, to control the stability with which the combustion takes place (the evenness of combustion) even more successfully, since the use of such a material results in good dissipation, through the composition, of the heat formed during the combustion. Consequently, the composition burns more easily and more evenly. The inventors assume that a suitable element or a suitable inorganic compound must have a coefficient of thermal conduction which is greater than the coefficient of thermal conduction of magnesium, i.e. the coefficient of thermal conduction is preferably greater than approximately 1.56 $W.cm^{-1}.K^{-1}$, which is the coefficient of thermal conduction of solid, polycrystalline magnesium at 298.2 K (see Handbook of Chemistry and Physics, CRC Press Inc., 59th Edition, p. E 14). At the same time, in this context, the exothermicity of the reaction between the additional element or the additional inorganic compound may play an important part in stabilizing and regulating the combustion of the composition according to the invention. Furthermore, it is preferred according to the invention for this embodiment to contain 0.1–15% by weight, based on the total quantity of the chlorine compound, alkaline-earth metal and alkaline-earth metal oxide, of the element or the inorganic compound. According to the invention, a particularly suitable element is aluminium and a particularly suitable inorganic compound is calcium silicide. The element may possibly also be carbon. If it were desired to use magnesium as the alkaline-earth metal and aluminium as the additional element, it would also be possible to use an alloy which contains magnesium and aluminium, such as magnalium. A second effect of using an additional element or an additional inorganic compound is that the reaction is accelerated.

It is assumed that a particle size of the metal or the inorganic metal compound having a reaction-accelerating and/or reaction-regulating effect according to the invention is of importance. Preferably, the average particle size of these materials is relatively small, for example 20–40 μm, and preferably approximately 30 μm, so that a large number of particles are present in the composition within the above-mentioned proportion by weight in the composition, with the result that a relatively large number of particles occur close together in the composition. The metal or the inorganic metal compound is then present in the composition in a well-dispersed state and is therefore able to dissipate the heat effectively and expediently through the entire composition. If the particles are much larger, the specified weight fraction will comprise relatively few particles, and the heat can therefore be dissipated less effectively through the composition.

Another important factor for regulating the burning rate and the burning temperature is the density to which the composition is compressed. According to the invention, the composition is preferably compressed to approximately 45–65%, in particular to 50–60%, of the theoretical maximum density, the theoretical maximum density (TMD) being understood to mean:

$$TMD=\Sigma 1/(x_n/\rho_n)$$

where $x_n$ is the mass fraction of a constituent and $\rho_n$ is the density of the constituent. The density of the compressed composition (true density) is calculated on the basis of the measured volume and the measured mass of the compressed composition, so that the percentage of the theoretical maximum density (% TMD) is equal to:

$$\%\ TMD=100\% *[(\text{true density})/TMD]$$

The composition according to the invention may contain one or more binders, in which case these binders are, for example, chlorine-containing polymers.

The invention furthermore relates to a product comprising a container which contains the composition according to the invention. Examples of such products or containers are smoke canisters and smoke hand grenades. If necessary, the composition in such products may have a higher density than approximately 45–65%. A product of small size such as a smoke hand grenade or a smoke canister will often require a density of preferably 60–90% and in particular a density of 65–85%.

The invention will be explained in more detail with reference to an example.

EXAMPLE 1

The compositions were prepared from the constituents, which were in the dry state, and then compressed to the desired percentage of the theoretical maximum density or were poured without compression. Table 1 shows the prepared compositions, where:

x=(number of moles of Mg)/(number of moles of Mg+number of moles of MgO)

y=(mass of Mg having an average particle size of 50–100 μm)/(mass of $Mg_{tot.}$)

% =percentage by weight

HC=hexachloroethane

TMD—theoretical maximum density

The burning rate of the various compositions was determined in a smoke pot (the figure shows a diagrammatic illustration in which the shaded part represents the composition) having an internal diameter of 30 mm and a height of 100 mm. This smoke pot comprises a base plate, a pipe section, a cover and three threaded rods which hold the smoke pot together. The base plate and the cover are made of stainless steel. The cover is provided, in the centre, with a hole having a diameter of 11.5 mm. The ratio between the surface area of the hole and the surface area of the composition is equal to the ratio of the total surface area of the holes and the surface area of the composition in a smoke grenade which is used in practice. The pipe section is made of stainless steel and has a wall thickness of 2.5 mm.

The compositions were ignited with the aid of a fuse containing black powder which, if appropriate, was applied to the composition with the aid of pyrotechnic lacquer. After ignition, the combustion time was measured. The (average) burning rate was then calculated from the combustion time and the level of the composition in the smoke pot.

According to the table, compositions 1–4 contain only hexachloroethane and magnesium having an average particle size of 150–300 μm. These tests showed that the combustion rate fell with increasing % TMD. In addition, these compositions were found to burn quickly and at a high temperature.

Compositions 5–7 consisted solely of hexachloroethane and magnesium having an average particle size of 150–300 μm, with the proviso that in this series of tests the quantity of magnesium was varied. As expected, it was found that at a constant % TMD the burning rate of the composition was increased with increasing magnesium content. These compositions likewise burned quickly and at a high temperature.

Compositions 8–11 consisted of hexachloroethane, varying quantities of magnesium having an average particle size of 150–300 μm and varying quantities of magnesium having an average particle size of 50–100 μm. Although the % TMD varied to some extent, the burning rates within the range of the ratio between magnesium having an average particle size of 150–300 μm and 50–100 μm, respectively, ($0 \leqq y \leqq 0.4$; see Table 1) were found not to differ greatly. This series of tests shows that the particle size of magnesium has virtually no influence on the burning rate of compositions consisting solely of hexachloroethane and magnesium.

Composition 12 contained only hexachloroethane and magnesium oxide, and this composition was impossible to ignite. When some of the magnesium oxide was replaced by magnesium having an average size of 150–300 μm, it was found that a molar fraction of magnesium of about 0.67 was required to ignite the composition (see composition 13). When magnesium having an average size of 50–100 μm was used, a molar fraction of magnesium of 0.5 was sufficient to enable the composition to be ignited (composition 14).

The tests carried out using compositions 15, 16 and 17 demonstrated the effect of incorporating an additional metal in the composition. These tests showed that at a constant % TMD the burning rate increased when the composition contained more aluminium. The same effect was observed when the compositions contained $CaSi_2$ (compositions 18 and 19).

TABLE 1

| Composition | x | y | HC (% by weight) | Al (% by weight) | $CaSi_2$ (% by weight) | TMD | % TMD | Burning rate (mm/s) |
|---|---|---|---|---|---|---|---|---|
| 1 | 1 | 0 | 62.5 | 0 | 0 | 1.944 | 44.4 | 3.90 |
| 2 | 1 | 0 | 62.5 | 0 | 0 | 1.944 | 55.6 | 2.48 |
| 3 | 1 | 0 | 62.5 | 0 | 0 | 1.944 | 65.0 | 1.76 |
| 4 | 1 | 0 | 62.5 | 0 | 0 | 1.944 | 67.1 | 1.66 |
| 5 | 1 | 0 | 76.4 | 0 | 0 | 1.996 | 56.5 | 1.23 |
| 6 | 1 | 0 | 72.5 | 0 | 0 | 1.981 | 56.9 | 1.44 |
| 7 | 1 | 0 | 67.5 | 0 | 0 | 1.962 | 56.6 | 1.89 |
| 8 | 1 | 0.1 | 62.5 | 0 | 0 | 1.944 | 51.3 | 2.52 |
| 9 | 1 | 0.2 | 62.5 | 0 | 0 | 1.944 | 55.6 | 2.48 |
| 10 | 1 | 0.4 | 62.5 | 0 | 0 | 1.944 | 54.8 | 2.61 |
| 11 | 1 | 0.4 | 62.5 | 0 | 0 | 1.944 | 53.5 | 2.67 |
| 12 | 0 | 0 | 50.1 | 0 | 0 | 2.638 | 42.7 | — |
| 13 | 0.667 | 0 | 57.7 | 0 | 0 | 2.162 | 52.9 | 1.31 |
| 14 | 0.5 | 1 | 55.6 | 0 | 0 | 2.276 | 48.5 | 1.81 |
| 15 | 0.5 | 0.4 | 55.6 | 0 | 0 | 2.276 | 55.0 | 0.87 |
| 16 | 0.5 | 0.4 | 54.5 | 2.0 | 0 | 2.284 | 55.2 | 1.01 |
| 17 | 0.5 | 0.4 | 52.9 | 5.0 | 0 | 2.294 | 56.1 | 1.37 |

TABLE 1-continued

| Composition | x | y | HC (% by weight) | Al (% by weight) | $CaSi_2$ (% by weight) | TMD | % TMD | Burning rate (mm/s) |
|---|---|---|---|---|---|---|---|---|
| 18 | 0.5 | 0.4 | 52.9 | 0 | 5.0 | 2.287 | 49.0 | 1.29 |
| 19 | 0.5 | 0.4 | 50.1 | 0 | 10.0 | 2.297 | 49.7 | 1.42 |

EXAMPLE 2

In these tests, transmission measurements were used to determine the volume of smoke formed by the various compositions as a function of the relative atmospheric humidity.

Table 2 shows the quantities of various compositions which were required in order to obtain the same transmission as was obtained with a conventional composition. A smaller quantity therefore indicates a more effective composition.

These tests show that the composition according to the invention is at least as satisfactory as a conventional composition at high atmospheric humidity, but without the drawback of being toxic. It was also found that a composition which generates potassium chloride and, just like the novel composition according to the invention, is non-toxic, is less effective over the entire range of relative atmospheric humidity.

TABLE 2

| Relative atmospheric humidity (%) | A[a] | B[b] | C[c] |
|---|---|---|---|
| 20 | 1.00 | 1.77 | 3.46 |
| 50 | 1.00 | 1.24 | 3.77 |
| 80 | 1.00 | 1.00 | 2.54 |

[a]Composition according to the prior art (hexachloroethane, ZnO);
[b]Composition according to the invention (55.1% by weight of hexachloroethane, x = 0.5, y = 0.4, 1.0% by weight Al);
[c]Composition generating potassium chloride (commercially available; composition unknown).

What is claimed is:

1. A composition for generating smoke, consisting essentially of at least one chlorinated or chlorine-containing compound having a chlorine content of at least 56% by weight of said at least one compound, and a mixture of at least one metal oxide and at least one metal, the metal oxide being an alkaline-earth metal oxide and the metal being an alkaline-earth metal, and wherein the molar fraction of alkaline-earth metal, based on the total number of moles of alkaline-earth metal and alkaline-earth metal oxide, is between 0.33 and 0.67, the alkaline-earth metal contains particles having an average size of 50–100 μm and particles having an average size of 150–300 μm.

2. A composition according to claim 1, wherein said compound is hexachloroethane.

3. A composition according to claim 1, wherein the alkaline-earth metal is at least one of magnesium and calcium.

4. A composition according to claim 1, wherein the alkaline-earth metal oxide is at least one of magnesium oxide and calcium oxide.

5. A composition according to claim 1, wherein the alkaline-earth metal comprises 25–50% by weight of particles having an average size of 50–100 μm and 50–75% by weight of particles having an average size of 150–300μm.

6. A composition according to claim 1, which comprises 0.01–15% by weight, based on the total quantity of said compound, the alkaline-earth metal and the alkaline-earth metal oxide, of a substance having at least one of a reaction accelerating effect and a reaction regulating effect.

7. A composition according to claim 6, wherein said substance is aluminum or calcium silicide.

8. A composition according to claim 1, which contains a binder.

* * * * *